United States Patent [19]

Churchman

[11] 4,154,018

[45] May 15, 1979

[54] TOY NOVELTY DEVICE

[76] Inventor: Fred L. Churchman, 451 Maxine Dr., Baton Rouge, La. 70808

[21] Appl. No.: 810,317

[22] Filed: Jun. 27, 1977

[51] Int. Cl.[2] ..... A63H 5/00

[52] U.S. Cl. ..... 46/191; 273/109; 46/174

[58] Field of Search ..... 46/191, 193, 197, 175 AR, 46/175 R, 52, 51, 47, 43, 177, 180, 174; 273/109, 110, 113

[56] References Cited

U.S. PATENT DOCUMENTS

| | | | |
|---|---|---|---|
| 454,254 | 6/1891 | Cohn | 273/110 |
| 465,066 | 12/1891 | Murphy | 46/191 |
| 3,113,782 | 12/1963 | Guier | 46/191 X |
| 3,545,121 | 12/1970 | Misko | 46/47 X |
| 3,710,504 | 1/1973 | Rylands | 46/1 R |
| 3,887,185 | 6/1975 | Landreville | 273/109 |

FOREIGN PATENT DOCUMENTS

| | | | |
|---|---|---|---|
| 640801 | 5/1962 | Canada | 46/191 |

*Primary Examiner*—Russell R. Kinsey
*Assistant Examiner*—Mickey Yu
*Attorney, Agent, or Firm*—Roy, Kiesel, Patterson & Abadie

[57] ABSTRACT

A toy novelty device is provided having an elongated hollow shaft into which is placed a projectile that can slide up and down the hollow shaft, a resounding chamber at one of the shaft's ends, and reflecting means blocking each end of the hollow shaft.

4 Claims, 10 Drawing Figures

TOY NOVELTY DEVICE

BACKGROUND OF THE INVENTION

Field of the Invention

This invention relates generally to amusement devices and toys, and more particularly to amusement devices which produce a rhythmic sound.

Prior Art

There are many sound producing amusement devices presently marketed. However, none of the devices provide the amount of motion, exercising and mental and manual co-ordination skill to operate which would attract a larger segment of consumers as desired.

SUMMARY OF THE INVENTION

Therefore, it is an object of this invention to provide an amusement device that requires both mental and manual co-ordination to operate.

Another object of this invention is to provide an amusement device that produces a rhythmic sound.

Still another object of this invention is to provide an amusement device that produces motion.

Other objects and advantages of this invention will become apparent from the ensuing description of the invention and the preferred embodiments.

Accordingly, an amusement device is provided comprising an elongated hollow shaft into which is placed a projectile which can move freely in the hollow shaft, a resounding chamber at one end of the shaft, and reflecting means blocking each end of the shaft to prevent the projectile from escaping out of the shaft.

In another embodiment, an amusement device is provided comprising a channel shaft having blocking handles attached at least to one end, reflecting means attached to the shaft and one of which is located near each end, and a projectile movably attached to the shaft between the reflecting means.

PREFERRED EMBODIMENTS OF THE INVENTION

Figure 1:
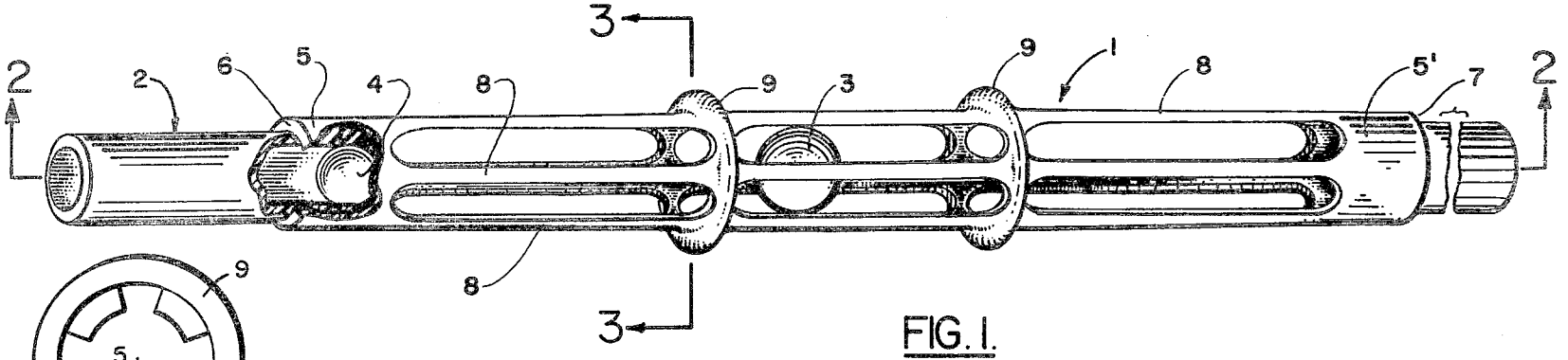
FIG. 1 is a cutaway perspective view of one embodiment of the amusement device of this invention.

Referring to FIG. 1, a perspective view of a representative embodiment of the amusement device comprising an elongated hollow shaft, denoted in general by numeral 1, resounding chamber, denoted in general by number 2, projectile 3 and reflecting means 4.

Figure 3:
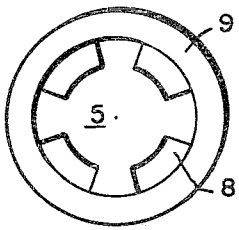
FIG. 3 is a cross-sectional view taken along lines 3—3 of FIG. 1.
Figure 2:
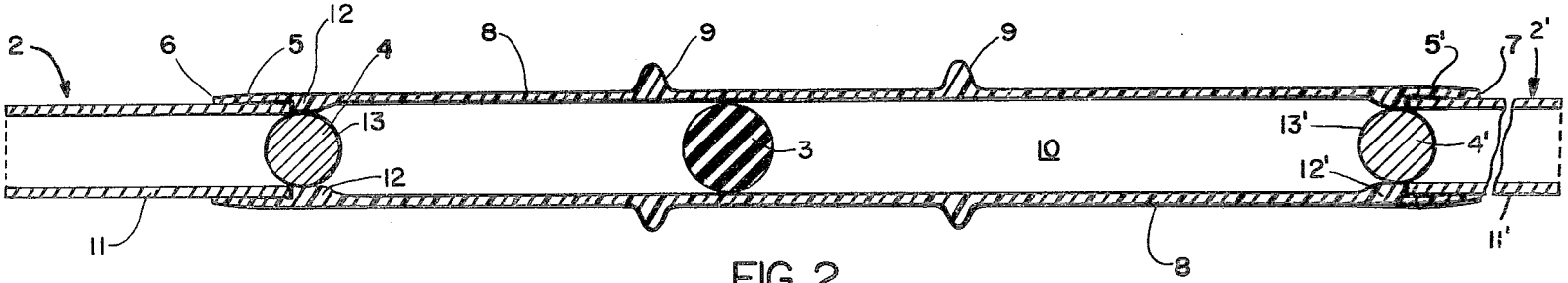
FIG. 2 is a cross-sectional view taken along lines 2—2 of FIG. 1.

In a preferred embodiment as shown in FIGS. 2 and 3, shaft 1 is formed by solid plastic tubing pieces 5 and each end 6 and 7, connected by separated ribs 8 having reinforcing rings 9 to strengthen and rigidify the shape of shaft 1. The tubing 5 and ribs 8 form cavity 10 into which projectile 3 is located and freely moves within cavity 10. Shaft 1 can be constructed from metal, as well as, plastic, and could be solid construction rather than ribbed as illustrated in FIGS. 1–3. If shaft 1 is solid, it is preferred that the material be clear to allow the user to see projectile 3 move during operation.

Resounding chamber 2 comprises a hollow tubing 11 positioned in end 5 of shaft 1 and held in position by the crimping action of end 5 which pinches down on tubing 11. Glue between end 5 and tubing 11 can also be used if desired. Tubing 11 extends into shaft 1 and forces reflecting means 4 (e.g. rubber ball) against wall ridge 12 which holds rubber ball 4 in a fixed position with a portion of its exterior surface 13 exposed to cavity 10 and in a position to be struck by projectile 3. In FIG. 2, there is a second resounding chamber 2' located at end 5' of shaft 1. Fitted in similar fashion, tubing 11' forcing ball 4' against wall ridge 12' with surface 13' protruding in cavity 10.

Figure 5:
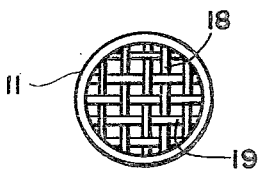
FIG. 5 is a perspective view of one embodiment of the reflecting means utilizable in the FIG. 4 embodiment.
Figure 6:
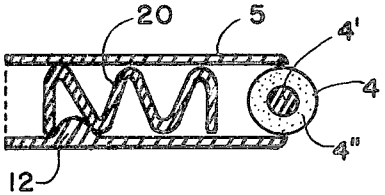
FIG. 6 is a partial cross-sectional view illustrating another alternate embodiment of the resounding chamber and hollow shaft end.
Figure 4:
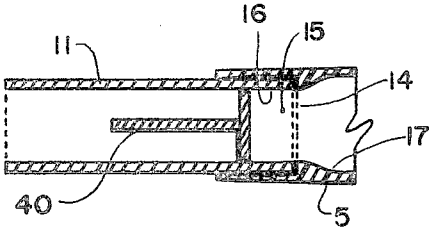
FIG. 4 is a partial cross-sectional view illustrating an alternate embodiment of the resounding chamber and hollow shaft end.

Various alternate embodiments of reflecting means 4 are illustrated in FIGS. 4, 5 and 6. As seen in FIG. 4, the reflecting means may be a resilient membrane 14 made from rubber or other similar material. In this embodiment, membrane 14 is stretched over opening 15 of tubing 11 and against tubing surface 16 where it is held in position by forcing tubing 11 against interior shoulder section 17 of shaft end 5. In a preferred embodiment, reed member 40 can be attached to tubing 11 to produce a variation in sound. As shown in FIG. 5, the membrane could be constructed from woven, resilient cross-strips 18, 19. FIG. 6 illustrates the use of coil spring 20 as the reflecting means and the construction of projectile 4 from a metal ball 4' having a rubber covering 4''.

Projectile 3 can be constructed of numerous materials and have various shapes so long as it is able to freely travel back and forth in cavity 10 and create an audible sound when it strikes the reflecting means. Examples of suitable materials for projectile 3 and reflecting means include, without limitation, steel and steel; hard plastic and hollow hard plastic; hard rubber and hard rubber; etc., but preferably steel and hard rubber (such as pressure molded rubber).

In operation, the amusement device is gripped at either end of shaft 1 and shaken up and down causing projectile 3 to alternately strike rubber ball 4 and 4' causing a resounding clatter which is amplified by chamber 2 and 2'. By varying the number of oscillation per unit time, different rhythms of sound can be produced.

Figure 8:
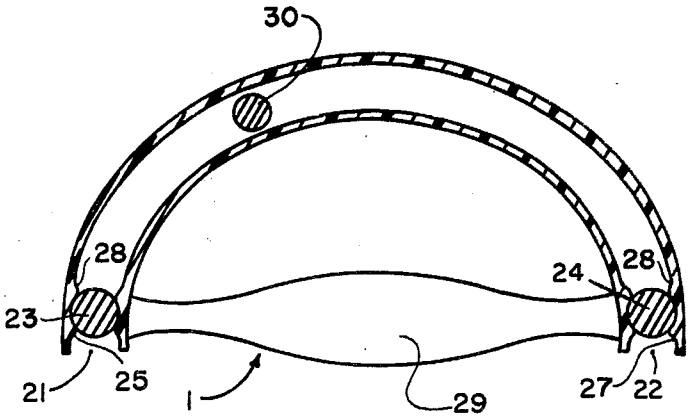
FIG. 8 is a cross-sectional view taken along lines 8—8 of FIG. 7.
Figure 7:
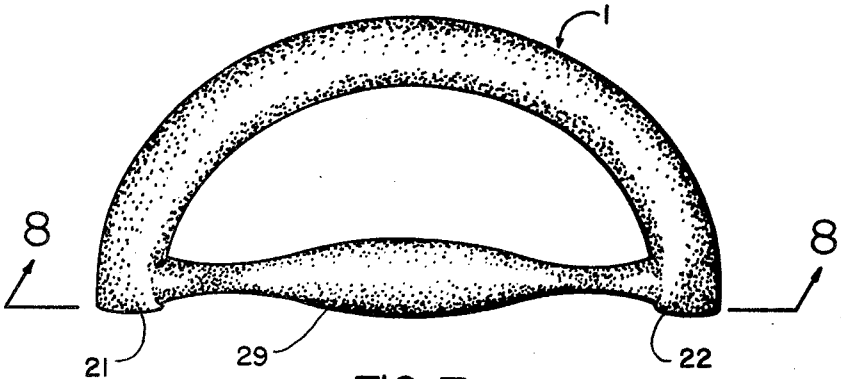
FIG. 7 is a perspective view of an alternate shape and embodiment of the amusement device of this invention.

Tubing 1 can be curved as shown in FIGS. 7 and 8. In this embodiment, resounding chamber 2 is constructed as a one piece extension of shaft 1 and comprises open ends 21 and 22 with rubber balls 23, 24 held in position between wall protrusions 25, 26 and 27, 28, respectively. In operation, a person grabs the amusement device by handle 29 and oscillates back and forth with a rocking motion causing metal ball 30 to alternately strike ball 23 and ball 24.

Figure 9:
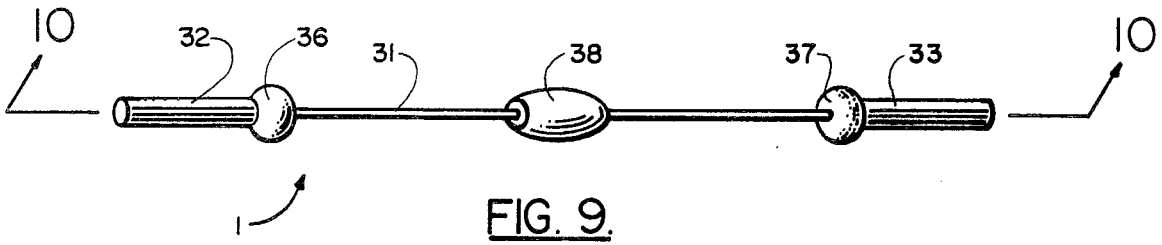
FIG. 9 is a perspective view of an alternate embodiment of this invention.
Figure 10:
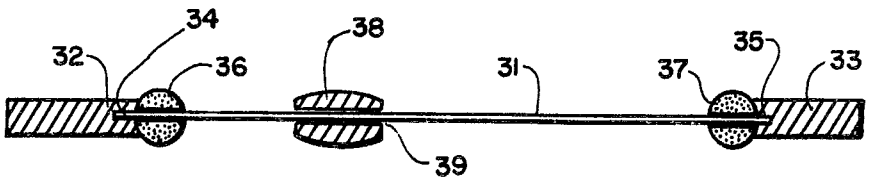
FIG. 10 is a cross-sectional view taken along lines 10—10 of FIG. 9.

Looking now at the embodiment illustrated in FIGS. 9 and 10, the amusement device 1 comprises a channel shaft 31 having handles 32, 33 attached at its opposite ends 34, 35, respectively; reflecting means 36, 37 attached to shaft 31 near ends 34, 35, respectively; and projectile 38 attached to shaft 31 between reflecting means 36, 37. More preferably, projectile 38 has channel 39 through which shaft 31 wherein channel 39 is wide enough to allow projectile 38 to travel up and down shaft 31 easily when the amusement device 1 is shaken up and down.

There are, of course, many alternate embodiments and other modifications not specifically described but which are included within the broad scope of the invention defined in the following claims.

What I claim is:

1. An amusement device comprising:

(a) an elongated hollow shaft having a cavity into which is located a projectile shaped to travel freely in said cavity;

(b) means to reflect said projectile back toward opposite ends of said cavity positioned to block each end of said cavity to prevent said projectile from escaping said cavity; and (c) a resounding chamber attached to one end of said cavity to receive and amplify any sound made when said projectile strikes said means, said resounding chamber comprising a hollow tube having a chamber cavity separated from said shaft cavity by said reflecting means at one end and which is open at its other end.

2. An amusement device according to claim 1 wherein said reflecting means is secured in position by a pair of wall protrusions extending from said hollow tube and on either side of said reflecting means.

3. An amusement device according to claim 1 wherein said reflecting means is secured in position by said tube pressing said reflecting means against wall ridges of said elongated hollow shaft, said ridges extending from said hollow shaft and on a side of said reflecting means opposite said tube.

4. An amusement device according to claim 1 wherein a reed member is attached within said chamber cavity.

* * * * *